US009360818B2

(12) United States Patent
Shibata

(10) Patent No.: US 9,360,818 B2
(45) Date of Patent: Jun. 7, 2016

(54) IMAGE FORMING APPARATUS AND IMAGE FORMATION METHOD HAVING TONER SAVING MODE

(71) Applicant: KYOCERA Document Solutions Inc., Osaka (JP)

(72) Inventor: Yukihiro Shibata, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/726,512

(22) Filed: May 30, 2015

(65) Prior Publication Data

US 2015/0346667 A1 Dec. 3, 2015

(30) Foreign Application Priority Data

May 30, 2014 (JP) ..... 2014-112051

(51) Int. Cl.
*G03G 15/00* (2006.01)
*B41J 2/505* (2006.01)

(52) U.S. Cl.
CPC ..... *G03G 15/556* (2013.01); *B41J 2/5054* (2013.01); *G03G 15/553* (2013.01)

(58) Field of Classification Search
CPC ..... G03G 15/556; G03G 15/5087; G03G 15/553; G03G 2215/00109; B41J 2/5054; B41J 3/01
USPC ..... 399/53
See application file for complete search history.

(56) References Cited

U.S. PATENT DOCUMENTS 6,856,430 B1 * 2/2005 Gase ..... G03G 15/5087 358/1.13
2001/0021031 A1 * 9/2001 Hashimoto ..... H04N 1/2307 358/1.9
2011/0200340 A1 * 8/2011 Kojima ..... G03G 15/0856 399/12
2011/0242560 A1 * 10/2011 Yamada ..... G03G 15/556 358/1.9

FOREIGN PATENT DOCUMENTS

JP H05-309871 A 11/1993
JP 07314783 A * 12/1995

* cited by examiner

*Primary Examiner* — Clayton E Laballe
*Assistant Examiner* — Trevor J Bervik
(74) *Attorney, Agent, or Firm* — Hawaii Patent Services; Nathaniel K. Fedde; Kenton N. Fedde

(57) ABSTRACT

Provided is an image forming apparatus that can fully reduce toner consumption. The image forming apparatus includes a memory part and a toner saving processing part. The memory part memorizes a toner saving table having a toner saving mode, a toner remaining threshold, a printing permission language, a language changing permission, and a changed classification. The toner saving processing part selects, when a specific fixed form document is printed according to a setup of the toner saving table memorized in the memory part, a language allowable to print with a least dot number for a specific fixed form document from a plurality of set languages. The toner saving processing part has a first saving mode that selects the language for each page when remaining toner amount is within a first range.

5 Claims, 5 Drawing Sheets

FIG.2

131

| TONER SAVING MODE | TONER REMAINING THRESHOLD | PRINTING PERMISSION LANGUAGE | LANGUAGE CHANGING PERMISSION | CHANGED CLASSIFICATION |
|---|---|---|---|---|
| NORMAL MODE | 50% OR MORE OF RESIDUAL QUANTITY | JAPANESE | NON-PERMISSION | |
| SAVING MODE 1 | 20 TO 50% OF RESIDUAL QUANTITY | JAPANESE, ENGLISH | PERMISSION | EACH PAGE |
| SAVING MODE 2 | 20% OR LESS OF RESIDUAL QUANTITY | JAPANESE, ENGLISH | PERMISSION | EACH SENTENCE |

FIRST PAGE

IMAGE FORMING APPARATUS AND IMAGE FORMATION METHOD HAVING TONER SAVING MODE

INCORPORATION BY REFERENCE

This application is based on and claims the benefit of priority from Japanese Patent Application No. 2014-112051 filed on May 30, 2014, the contents of which are hereby incorporated by reference.

BACKGROUND

The present disclosure is related with an image forming apparatus and an image formation method having a toner saving mode.

Some of typical image forming apparatuses have a toner saving mode that reduces toner consumption. For example, in a typical technology, when remaining toner amount decreases, a print font is changed into an outline font, only a border line of a character is printed, and toner consumption is reduced.

SUMMARY

An image forming apparatus of the present disclosure includes a memory part and a toner saving processing part. The memory part memorizes a toner saving table having a toner saving mode, a toner remaining threshold, a printing permission language, a language changing permission, and a changed classification. The toner saving processing part selects, when a specific fixed form document is printed according to a setup of the toner saving table memorized in the memory part, a language allowable to print with a least dot number for the specific fixed form document from a plurality of set languages. An image formation method of the present disclosure is an image formation method executed by an image forming apparatus. First, a toner saving table having a toner saving mode, a toner remaining threshold, a printing permission language, a language changing permission, and a changed classification is memorized. Then, when a specific fixed form document is printed according to a setup of the toner saving table memorized in the memory part, a language allowable to print with a least dot number for the specific fixed form document is selected from a plurality of set languages.

BRIEF DESCRIPTION OF THE DRAWINGS

FIG. 2 is an image figure of the toner saving table as shown in FIG. 1;

DETAILED DESCRIPTION

Hereinafter, with reference to figures, an embodiment of the present disclosure is described in detail. In addition, in the following embodiments, the same numerals are given to configuration that indicates a similar function.

Figure 1:
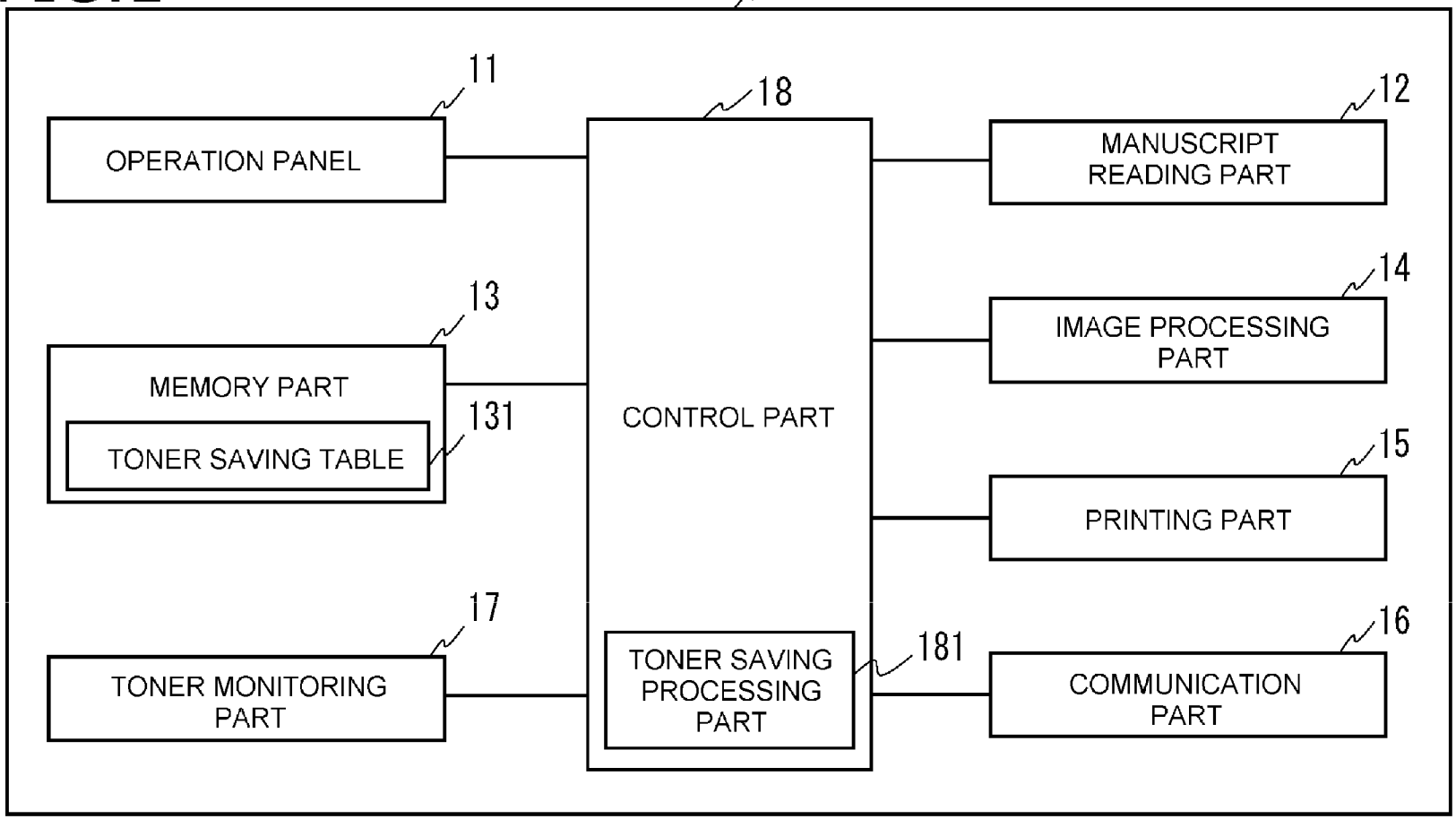
FIG. 1 is a block diagram indicating a configuration of an image forming apparatus in the embodiment related to the present disclosure.

As shown in FIG. 1, image forming apparatus 1 includes operation panel 11, manuscript reading part 12, memory part 13, image processing part 14, printing part 15, communication part 16, toner monitoring part 17, and control part 18.

Operation panel 11 has a touch panel and a manual operation button. The touch panel functions as a display part and an input part. The display part displays various operation keys and an image formation status. The display part has touch sensor, which may be transparent. The touch panel detects touch operation to a display surface and outputs a signal corresponding to a position where the touch operation is detected. Accordingly, an operation to the operation key displayed on the display part is accepted. Also, the manual operation button includes various operation keys, such as a numeric keypad, a reset key, a stop key, and a start key. The numeric keypad is an operation key for inputting numerical values, such as printing number of sheets. The reset key is an operation key for inputting an instruction that initializes setup information. The stop key is an operation key for stopping copying operation. The start key is an operation key for inputting an instruction that make the operation based on the setup information start.

Manuscript reading part 12 is a scanner that irradiates light to a manuscript, receives reflected light, and reads an image of the manuscript. The manuscript is fed by a manuscript sheet feeding device that is not illustrated, or it is placed on platen glass by the user.

Memory part 13 is a non-transitory recording medium. Memory part 13 accumulates image data that is read by manuscript reading part 12, image data received by communication part 16, or the like. Also, toner saving table 131, which is set each toner saving mode, is memorized in memory part 13.

Image processing part 14 is a circuit that performs specified image process to the image data. In image processing part 14, for example, a scaling process, an image improvement process of density control or gradation adjustment, or the like, is performed.

Printing part 15 prints the image data memorized in memory part 13. Printing part 15 forms, for example, a latent image on a surface of a photo conductor drum based on the image data read from memory part 13. Also, printing part 15 performs image formation that makes the latent image a toner image and makes a recording paper transfer the toner image from the photo conductor drum with toner. Also, printing part 15 fixes the toner image to a recording paper and discharges the recording paper.

Communication part 16 has a function that transmits and receives various data with an external terminal, such as a personal computer.

Toner monitoring part 17 has a function that monitors residual quantity of the toner.

Control part 18 is connected to operation panel 11, manuscript reading part 12, memory part 13, image processing part 14, printing part 15, communication part 16, and toner monitoring part 17, respectively. Control part 18 is an information processing part, such as a microcomputer provided with a non-transitory recording medium. A control program for operation-controlling image forming apparatus 1 is memorized in the recording medium. Control part 18 reads the control program memorized in the recording medium, executes by expanding the control program, and controls a whole device. Also, control part 18 functions as toner saving processing part 181. When printing a fixed form document, toner saving processing part 181 checks remaining toner amount via toner monitoring part 17. Further, toner saving processing part 181 changes printing language according to the remaining toner amount. The specific fixed form document is a sentence that a print item is determined, such as a status page, a management report, FAX transmission record, a transmission error, and a watermark. Also, each specific fixed form document may contain a plurality of sentences. Even if it is the same fixed form document, a dot number of printing (total value of the dot number that composes each character of the fixed form document) changes with language, and toner consumption changes according to dot numbers. Therefore, printing cost can be reduced by changing the printing language by toner saving processing part 181.

FIG. 2 is an image figure of toner saving table 131 showing an example for a setting of each toner saving mode. Toner saving table 131 includes a toner saving mode, a toner remaining threshold, a printing permission language, a language changing permission, and a changed classification.

In the toner saving mode, a type of toner saving mode is set. In an example here, three modes, such as "normal mode", "saving mode 1", and "saving mode 2", are set.

In the toner remaining threshold, a threshold of the remaining toner amount for shifting to each toner saving mode is set. In an example here, "normal mode" is set for a case of "50% or more of remaining toner amount."

Also, "saving mode 1" is set for a case of "20%-50% of remaining toner amount."

Also, "saving mode 2" is set for a case of "20% or less of remaining toner amount."

In the printing permission language, a user can set a language to permit printing the fixed form document. A plurality of languages can be set in the printing permission language. In the plurality of languages set in the printing permission language, the language of the least dot number in printing of the fixed form document is selected, automatically. The dot number is a value that summed up a number of dots composing each character in the fixed form document. Then, the fixed form document is printed in the selected language. Therefore, it is good to set the language that the user can understand. In addition, in the printing permission language of each the toner saving mode, at least a set language, which is set up by initial setting or the like of image forming apparatus 1 (in FIG. 2, Japanese,) may be set as default languages, automatically.

In the language changing permission, it is set whether changing the language is permitted for each page or each sentence. In an example here, the case of "normal mode" is set as the "non-permission."

In the case of "saving mode 1" and "saving mode 2" are set as "permission."

The changed classification becomes possible to be set when the language changing permission is set as "permission." The changed classification can be set either "each page" or "each sentence."

Figure 3:
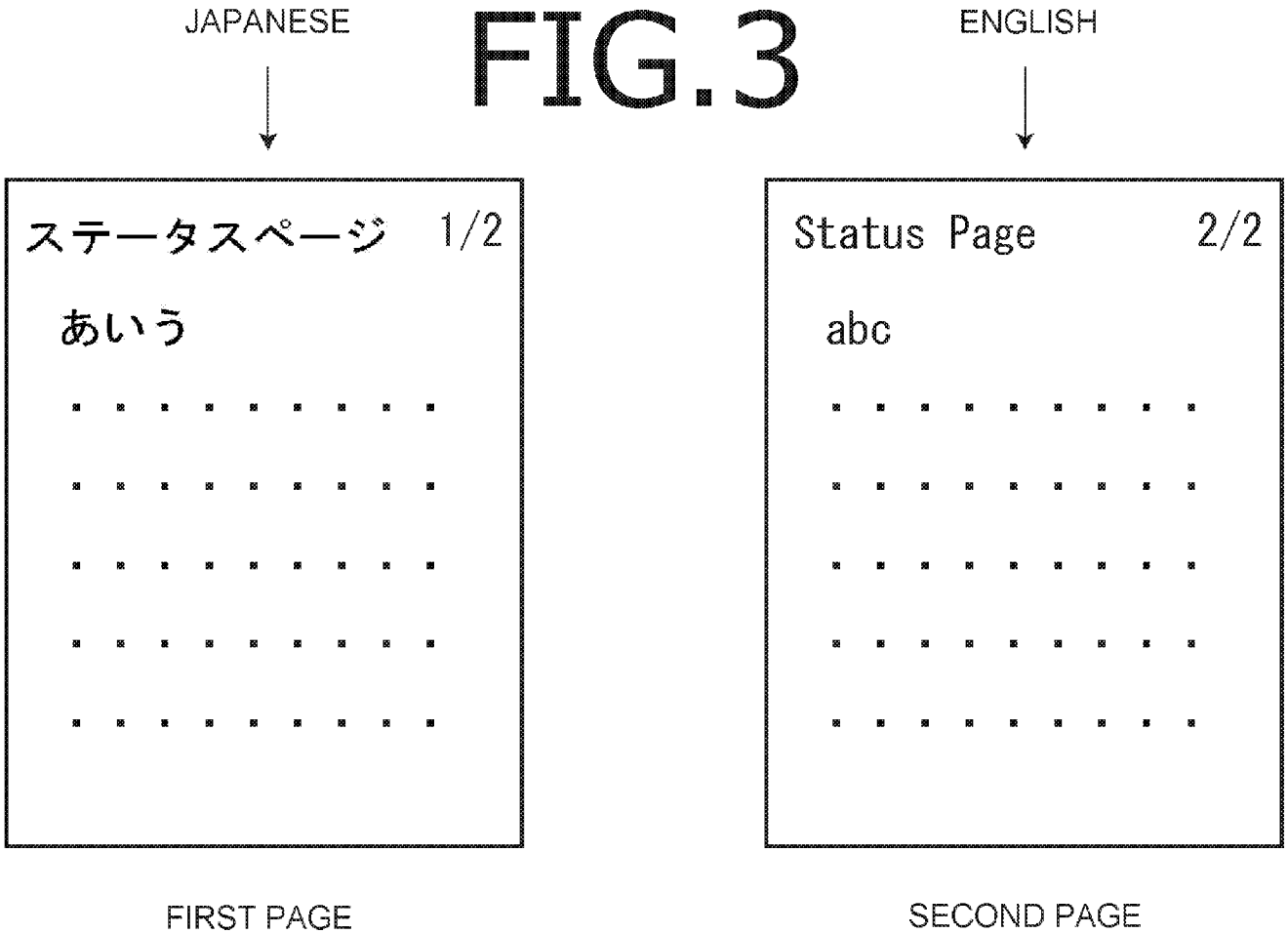
FIG. 3 is a print image figure at the time of permitting a language change for each page in the toner saving table as shown in FIG. 2.
Figure 4:
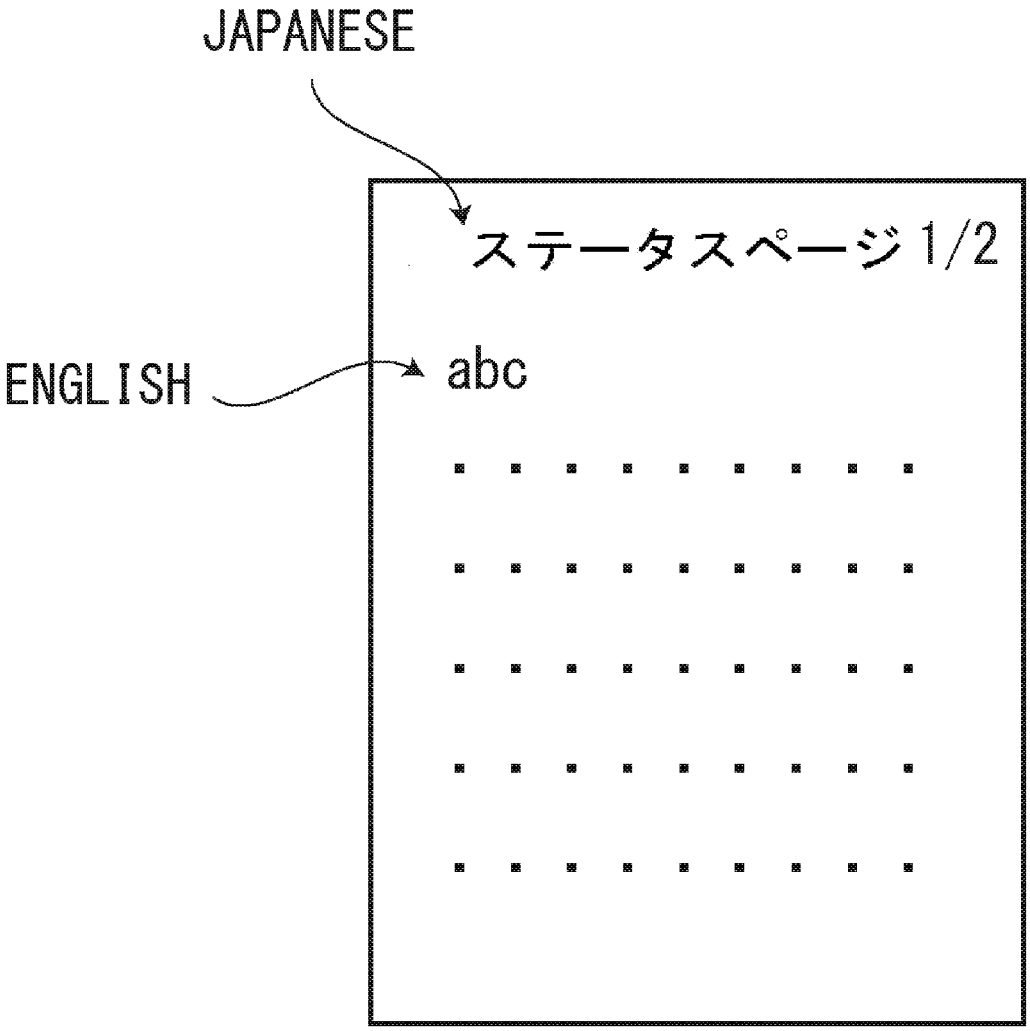
FIG. 4 is a print image figure at the time of permitting a language change for each sentence in the toner saving table as shown in FIG. 2.

In the case of "each page," for each page, when printing the page of the entire fixed form document, the printing language having the least dot number in the language set in the printing permission language is selected. In the case of "each sentence," for each one sentence of the fixed form document (for example, one composition having a meaning, such as a sentence and an item,) for printing of one sentence, the printing language having the least dot number in the language set in the printing permission language is selected. Namely, as shown in FIG. 3, in the case of "each page," the printing language within a page is the same, but the printing language of the next page may differ from the printing language in the former page. Also, as shown in FIG. 4, in the case of "each sentence," the fixed form document is printed by a plurality of printing languages within a page. Since the printing language in "each sentence" is more finely changed than in "each page" so that the dot number may decrease, the reduction efficiency of toner consumption is large. In addition, it may select a printing language for each word. However, readability of the fixed form document is taken into consideration here, and "each sentence" is adopted.

In addition, when the language changing permission is set as the "non-permission", the printing language is not changed for each page and each sentence. Accordingly, it is usually printed in the default printing language (the set language, which is set up.)

Also, memory part 13 memorizes a language set of a plurality of languages corresponding to the printing permission language and the dot numbers of each language needed to print for each page and each sentence for each fixed form document.

Figure 5:
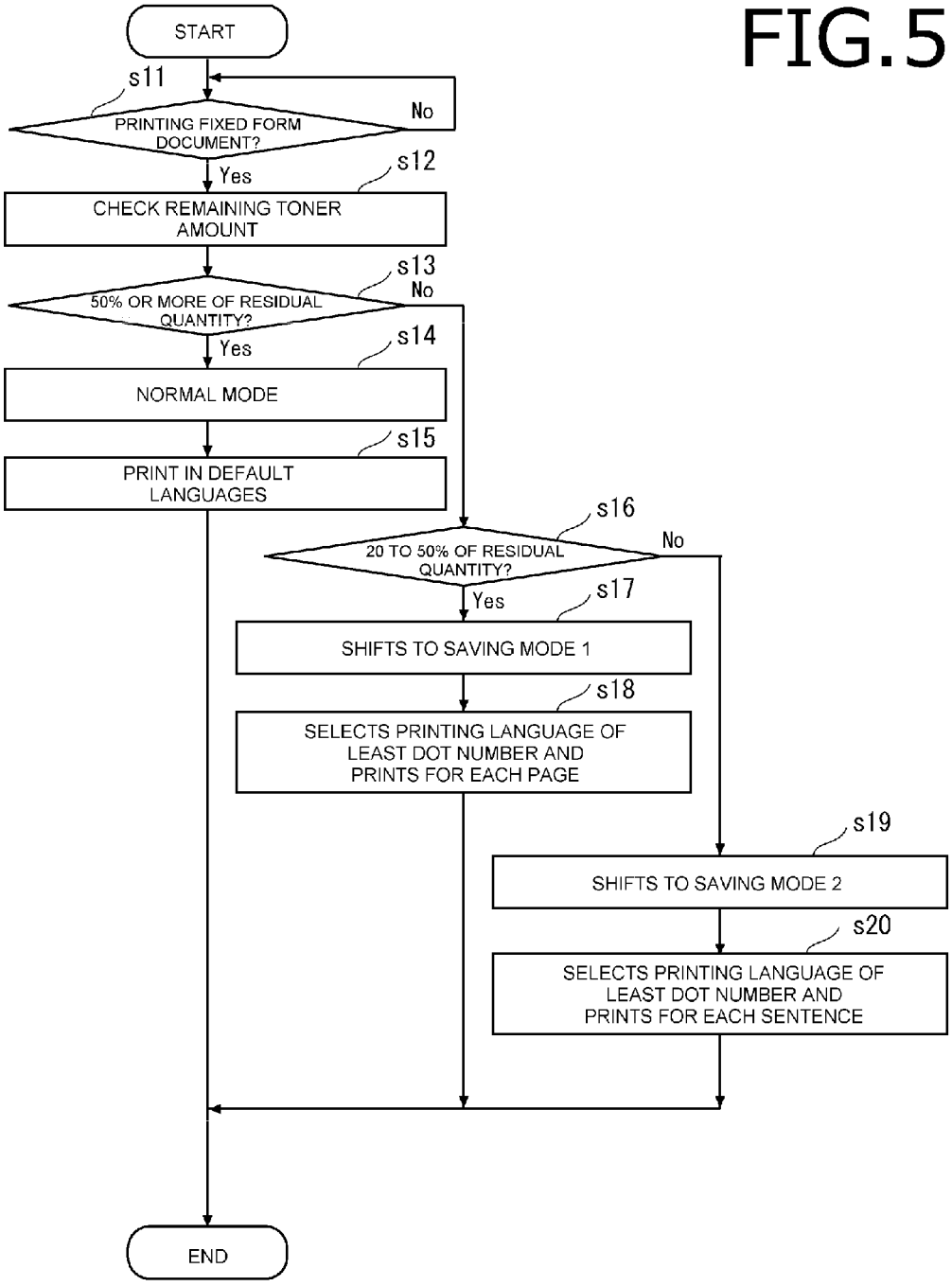
FIG. 5 is a flow chart that indicates a process flow of a toner saving processing part as shown in FIG. 1.

With reference to FIG. 5, a process flow of toner saving processing part 181 is explained in detail. Here, toner saving processing part 181 is advancing the process according to the setup of toner saving table 131.

Toner saving processing part 181 determines whether or not the fixed form document is printed (Step s11). If not printing the fixed form document (No at Step s11), Toner saving processing part 181 returns a process to Step s11. If printing the fixed form document (Yes at Step s11), toner saving processing part 181 checks remaining toner amount via toner monitoring part 17 (Step s12).

If the remaining toner amount is 50% or more (50% to 100%) (Yes at Step s13), toner saving processing part 181 sets in the normal mode (Step s14). In the normal mode, toner saving processing part 181 usually prints the fixed form document in the default languages (Step s15) and ends the present process.

On the other hand, if the remaining toner amount is not 50% or more (No at Step s13) and the remaining toner amount is 20%-50% (Yes at Step s16), toner saving processing part 181 shifts to saving mode 1 (Step s17). In saving mode 1, toner saving processing part 181 selects the language having the least dot numbers for each page among the language set in the printing permission language, prints each page (Step s18), and ends the present process.

If the remaining toner amount is not 20%-50% (No at Step s16), namely, the case of the remaining toner amount is 20% or less (0 to 20%), toner saving processing part 181 shifts to saving mode 2 (Step s19). In saving mode 2, toner saving processing part 181 selects the language having the least dot numbers for each sentence of the printing fixed form document among the language set in the printing permission language. Then, toner saving processing part 181 prints each sentence of the fixed form document (Step s20) and ends the present process.

Thus, according to the present embodiment, when printing the fixed form document, according to the remaining toner amount, the printing language having the least dot numbers is selected and printed. In detail, when the remaining toner amount is 50% or more, it usually prints with the default language. Also, when the remaining toner amount is 20 to 50%, the language having the least dot numbers is selected and printed for each page among the language set in the printing permission language. Also, when the remaining toner amount is 20% or less, the language having the least dot numbers is selected and printed for each sentence of the fixed form document among the language set in the printing permission language. Therefore, according to the present embodiment, toner consumption can sufficiently be saved, and printing cost can be reduced. Also, according to the present embodiment, since the printing language of the fixed form document is only changed, the amount of information for printing is not damaged. Also, in the present embodiment, since a timing to change the printing language is set for each page or each sentence, reduction of readability can be prevented.

As explained in detail, in the typical image forming apparatus having a toner saving mode, toner consumption cannot fully be reduced. As compared with this, according to the present disclosure, a technology that can fully reduce toner consumption can be provided.

The present disclosure is not limited to the embodiment mentioned above, and it cannot be overemphasized that it can change of all sorts in the range that does not deviate from the aim of the present disclosure.

For example, toner saving processing part 181 may show a message that inquires whether or not making ineffective the language change in the timing of printing. It is for a user who is troubled if printing in a language other than the default language. If making ineffective the language change in the message is instructed, the language change is make ineffective as if remaining toner amount is a level for the saving mode 1 or 2. Then, printing may be performed in the default languages.

Also, number of each the set value in toner saving table 131 or saving modes is just an example. A user can be set these, arbitrarily. For example, even if it is the normal mode, the user can set a plurality of languages to permit printing, and he or she can also set to permit the language change. Also, toner saving processing part 181 does not need to change the printing language for each page or each sentence. For example, the printing language may be changed for each material consisting of two or more pages.

What is claimed is:

1. An image forming apparatus comprising:

a memory part that memorizes a toner saving table having a toner saving mode, a toner remaining threshold, a printing permission language, a language changing permission, and a changed classification; and a toner saving processing part that selects, when a specific fixed form document is printed according to a setup of the toner saving table memorized in the memory part, a language allowable to print with a least dot number for the specific fixed form document from a plurality of set languages.

2. The image forming apparatus according to claim 1, wherein the toner saving processing part has a first saving mode that selects the language for each page when remaining toner amount is within a first range.

3. The image forming apparatus according to claim 1, wherein the toner saving processing part has the second saving mode that selects the language for each sentence when remaining toner amount is within a second range having less remaining toner amount than the first range.

4. The image forming apparatus according to claim 1, wherein the toner saving processing part accepts a setup that makes ineffective the selection of the language in a timing of printing the specific fixed form document.

5. An image formation method executed by an image forming apparatus, comprising the steps of:

memorizing a toner saving table having a toner saving mode, a toner remaining threshold, a printing permission language, a language changing permission, and a changed classification; and selecting, when a specific fixed form document is printed according to a setup of the toner saving table, a language allowable to print with a least dot number for the specific fixed form document from a plurality of set languages.

* * * * *